US008510906B2

(12) United States Patent
Lee

(10) Patent No.: US 8,510,906 B2
(45) Date of Patent: Aug. 20, 2013

(54) UPRIGHT TYPE VACUUM CLEANER

(75) Inventor: Dong-yun Lee, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 946 days.

(21) Appl. No.: 12/589,342

(22) Filed: Oct. 22, 2009

(65) Prior Publication Data

US 2010/0037420 A1 Feb. 18, 2010

Related U.S. Application Data

(63) Continuation-in-part of application No. 11/601,510, filed on Nov. 17, 2006, now abandoned.

(30) Foreign Application Priority Data

Jun. 30, 2006 (KR) ..... 10-2006-0061069

(51) Int. Cl.
*A47L 9/10* (2006.01)

(52) U.S. Cl.
USPC ..... 15/347; 15/350; 15/352

(58) Field of Classification Search
USPC ..... 15/347–353
IPC ..... A47L 9/10
See application file for complete search history.

(56) References Cited

U.S. PATENT DOCUMENTS

| | | | | |
|---|---|---|---|---|
| 6,735,816 | B2 * | 5/2004 | Oh et al. | 15/353 |
| 6,757,933 | B2 | 7/2004 | Oh et al. | |
| 6,918,156 | B2 | 7/2005 | Joo et al. | |
| 6,928,692 | B2 | 8/2005 | Oh et al. | |
| 7,377,010 | B2 | 5/2008 | Harsh et al. | |
| 2001/0002500 | A1 | 6/2001 | Kasen et al. | |
| 2003/0121121 | A1 | 7/2003 | Nakai et al. | |
| 2003/0145421 | A1 | 8/2003 | Choi | |
| 2003/0159237 | A1 | 8/2003 | Oh | |
| 2005/0138761 | A1 | 6/2005 | Park et al. | |
| 2005/0138763 | A1 | 6/2005 | Tanner et al. | |

FOREIGN PATENT DOCUMENTS

| | | |
|---|---|---|
| GB | 2361863 | 3/2001 |
| KR | 1020030066899 | 8/2003 |
| KR | 1020040099980 | 12/2004 |
| KR | 1020050119737 | 12/2005 |

OTHER PUBLICATIONS

Official Action issued from Korean Intellectual Property Office corresponding to Korean Patent Application No. 2006-61069 dated May 28, 2007.

* cited by examiner

*Primary Examiner* — David Redding
(74) *Attorney, Agent, or Firm* — Ohlandt, Greeley, Ruggiero & Perle, LLP.

(57) ABSTRACT

An upright type vacuum cleaner is provided that includes a cleaner body formed with a mounting space; a vacuum motor mounted in the cleaner body to produce suction force; a brush assembly connected to the cleaner body; a dust collection device mounted in the mounting space and having a dust collection bin; and a lifting/lowering unit for lifting or lowering the dust collection bin in relation to the cleaner body, so that the dust collection bin is anchored in the mounting space or removed from the mounting space, wherein the cyclone cylinder has a locking handle and a handle connection part is formed on a corresponding part of the cleaner body so that the locking handle can be removably connected to the handle connection part.

17 Claims, 14 Drawing Sheets

UPRIGHT TYPE VACUUM CLEANER

CROSS-REFERENCE TO RELATED APPLICATIONS

This application is a continuation-in-part of U.S. application Ser. No. 11/601,510 that was filed on Nov. 17, 2006 now abandoned, which claims priority under 35 U.S.C §119(a) from Korean Patent Application No. 10-2006-0061069 filed Jun. 30, 2006, in the Korean Intellectual Property Office, the disclosure of both of which are incorporated herein by reference.

BACKGROUND OF THE INVENTION

1. Field of the Invention

The present disclosure relates to a vacuum cleaner for cleaning a surface, and more particularly, to an upright type vacuum cleaner having a lifting/lowering unit for use in mounting a dirt collection bin on a cleaner body or removing the dirt collection bin from the cleaner body.

2. Description of the Related Art

Generally, an upright type vacuum cleaner is an appliance for drawing-in dust-contained in air, removing dust from the air, and discharging dust-free air, wherein such a vacuum cleaner comprises a cleaner body and a dust collection device mounted in a mounting space formed on the cleaner body. The dust collection device comprises a dust collection bin for temporarily storing filtered dust, wherein in order to receive filtered dust, the dust collection bin should be fixed to the mounting space in the vacuum cleaner in such a manner that the dust collection bin is neither shaken nor released, and when the dust fills the dust collection bin to some extent, the dust collection bin should be removed from the mounting space so as to throw away the collected dust.

In particular, an upright type vacuum cleaner employs a lifting/lowering unit for use in lifting or lowering a dust collection bin within a mounting space so as to mount or remove the dust collection bin. Such a lifting/lowering unit is mounted on the bottom wall of the mounting space formed on the cleaner body so that when the lifting/lowering unit is lifted from the bottom of the mounting space, it pushes the dust collection bin upward, thereby making the dust collection bin come into close contact with a cyclone cylinder so as to fix the dust collection bin in such a manner as to be unmovable, or when the lifting/lowering unit is lowered and thus returned to its original position, the dust collection bin is spaced from the cyclone cylinder.

However, in the related-art upright type vacuum cleaner, the cyclone cylinder of the dust collection device is anchored to the cleaner body by 4 (four) screws. Therefore, it is not easy to maintain and repair the vacuum cleaner, and, in some situation, the lifetime of the vacuum cleaner may be shortened. That is, in order to anchor the cyclone cylinder to the cleaner body or separate the cyclone cylinder from the cleaner body, an extra tool such as a screw driver is required and also it takes much time to screw or unscrew the cyclone cylinder to or from the cleaner body.

Also, in order to clean or repair the cyclone cylinder, an operation of screwing or unscrewing the cyclone cylinder is necessarily required. If the number of screwing or unscrewing operations increases, damage to a screwing part of the cleaner body may be incurred, thereby making it impossible to use the vacuum cleaner.

Further more, in the related-art upright type vacuum cleaner, friction is necessarily produced between the dust collection bin and the protrusion of a mounting/dismounting means when the dust collection bin is spaced from the cleaner body.

Also, the dust collection bin should be frequently spaced from the cleaner body in order to be emptied. Therefore, the friction caused by long term use of the vacuum cleaner incurs a scratch on an inclination recess of the dust collection bin.

The scratch does not affect the performance of the vacuum cleaner but spoils the appearance of the vacuum cleaner in consideration of that the dust collection bin is formed of a transparent material by injection-molding. That is, the reliability of a product is affected by the scratch.

The publication of Korean Patent No. 433407 owned by the applicant also discloses a vacuum cleaner, wherein a lifting/lowering unit is installed on the bottom wall of a mounting space for receiving a dust collection device, the mounting space being formed on the cleaner body of the vacuum cleaner, and a dust collection bin, which is laid on the top of the lifting/lowering unit, comes into close contact with the cyclone cylinder or is spaced from the cyclone cylinder as a lever part is rotated left or right. However, because an air tubing, which is provided within the vacuum cleaner, and through which air from the cyclone cylinder is discharged, is curved toward the cleaner body of the vacuum cleaner, the flow passage for discharge air is increased, which results in a pressure loss. In addition, the cyclone cylinder is mounted in the mounting space and only the dust collection bin is removable. Therefore, there was a disadvantage in that when the dust collection bin is removed, dust or the like deposited on the inner wall of the cyclone cylinder drops, thereby causing the pollution or even the malfunction of the lifting/lowering unit and reducing the lifetime of the lifting/lowering unit.

The publication of Korean Patent No. 471142 also owned by the applicant also discloses a vacuum cleaner in which air discharged from a cyclone chamber is adapted to be discharged through the bottom wall of a dust collection bin so as to reduce the length of tubing for use in discharging air from the cyclone chamber, as a result of which the loss of pressure in the tubing can be reduced. However, with such a construction, it was difficult to apply a lifting/lowering unit for lifting and lowering the dust collection bin due to the leakage of air between the dust collection bin and the body of the vacuum cleaner, for which problem researches have been continuously made.

SUMMARY OF THE INVENTION

Accordingly, aspects of the present disclosure are to address at least the above problems. Therefore, a first aspect of the present disclosure is to provide an upright type vacuum cleaner, which can mount or dismount a cyclone cylinder in or from a cleaner body easily and rapidly without an extra tool such as a screw driver.

A second aspect of the present disclosure is to provide an upright type vacuum cleaner, which can mount or dismount a dust collection bin in or from a cleaner body without causing friction.

A third aspect of the present disclosure is to provide a vacuum cleaner, which can reduce the pressure loss in a flow passage of discharge air as well as suppress the leakage of discharge air occurring in a lifting/lowering unit interposed between a dust collection bin and a cleaner body.

A fourth aspect of the present disclosure is to provide a vacuum cleaner, which can reduce the pollution of a lifting/lowering unit, thereby reducing the malfunction of the lifting/lowering unit, as well as increasing the lifetime of the lifting/lowering unit.

To achieve the above-described object, there is provided an upright type vacuum cleaner comprising: a cleaner body formed with a mounting space; a vacuum motor mounted in the cleaner body to produce suction force; a brush assembly connected to the cleaner body; a dust collection device mounted in the mounting space and having a dust collection bin and a cyclone cylinder; and a lifting/lowering unit for lifting or lowering the dust collection bin in relation to the cleaner body so that the dust collection bin is anchored in the mounting space or removed from the mounting space, respectively, wherein the cyclone cylinder has a locking handle and a handle connection part is formed on a corresponding part of the cleaner body so that the locking handle can be removably connected to the handle connection part.

The locking handle may be a rotary knob.

The dust collection bin may be anchored by the lifting/lowering unit that is vertically movable.

The lifting/lowering unit may comprise a lever part that is rotatably mounted on the cleaner body, and a locking disk that vertically moves in association with the rotation of the lever part.

The lever part and the locking disk may be operated in a cam manner.

According to another embodiment of the present disclosure, there is provided an upright type vacuum cleaner, comprising: a cleaner body that has a vacuum generation device mounted therein and a brush assembly formed at the lower side thereof; a cyclone cylinder that separates dirt from air drawn in through an inflow passage communicating with the brush assembly, and discharges cleaned air through a discharge passage communicating with the vacuum generation device; and a dust collection bin that is removably connected to the lower side of the cyclone cylinder and collects dirt separated from the air in the cyclone cylinder, wherein the dust collection bin is anchored by a lifting/lowering unit.

The lifting/lowering unit may comprise a lever part that is rotatably mounted on the cleaner body, and a locking disk that vertically moves in association with the rotation of the lever part.

The locking disk may be operated in a cam manner.

The lifting/lowering unit may be installed at the lower end of the dust collection bin and may be mounted in or dismounted from the mounting space along with the dust collecting bin.

The outer bottom surface of the dust collection bin may be formed with a recess, and the lifting/lowering unit may be fitted in the recess.

The lifting/lowering unit may comprise: a lifting/lowering control member fitted in the recess; and a plurality of cam guides that are provided on the lifting/lowering control member and the outer bottom surface of the dust collection bin, respectively, upon rotation of the lifting/lowering control member.

The lifting/lowering control member may comprise a lever part capable of being gripped by a hand and a body part integrally formed with the lever part.

The plurality of cam guides may comprise first and second cam guides projecting from the outer bottom surface of the dust collection bin, and third and fourth cam guides projecting from the body part in such a manner as to be engaged with the first and second cam guides.

The plurality of cam guides may further comprise a fifth cam guide projecting from the outer bottom surface of the dust collection bin in such a manner as to come into contact with the lever part, thereby separating the lever part from the outer bottom surface of the dust collection bin.

The outer bottom surface of the dust collection bin may include an air outlet port formed therethrough and the body part of the lifting/lowering unit may include a bore formed therein, so that air purified in the dust collection device is introduced into a motor chamber, within which the vacuum motor is installed, via the air outlet and the bore.

The upright type vacuum cleaner may further comprise a discharge flow passage within the cleaner body for communicating between a motor chamber, within which the vacuum motor is installed, and a cyclone cylinder of the dust collection device in order to discharge air to the motor chamber.

The dust collection bin may comprise a cylindrical rotary shaft extending from the outer bottom surface of the dust collection bin.

The body part of the lifting/lowering control member may comprise a cylinder into which the cylindrical rotary shaft can be inserted so as to center the lifting/lowering control member when the lifting/lowering control member is rotated.

BRIEF DESCRIPTION OF THE DRAWING FIGURES

The above aspects and features of the present disclosure will be more apparent by describing certain embodiments of the present disclosure with reference to the accompanying drawings, in which.

DETAILED DESCRIPTION OF AN EXEMPLARY EMBODIMENT

Figure 1:
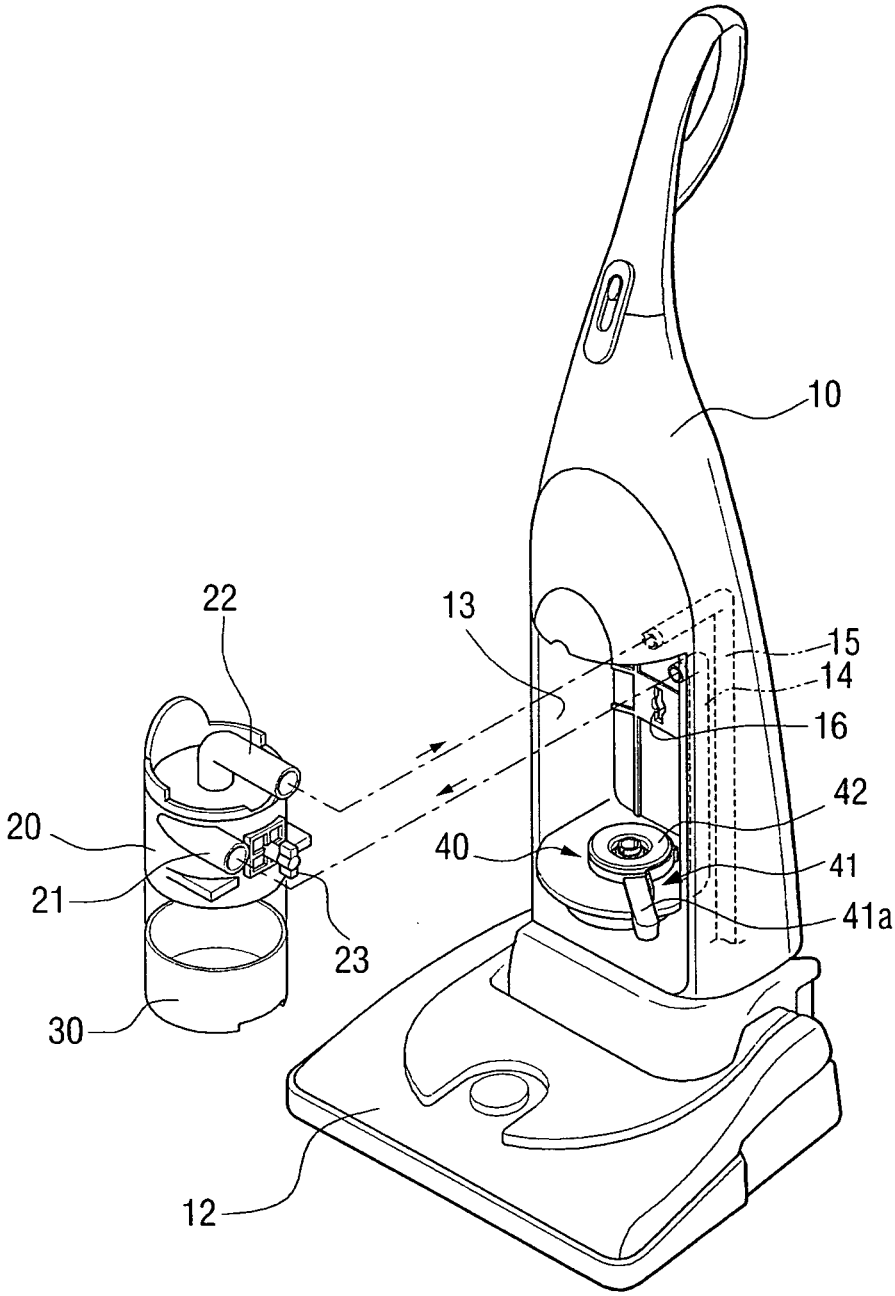
FIG. 1 is an exploded perspective view showing an upright type vacuum cleaner according to a first embodiment of the present disclosure.

Exemplary embodiments of the present disclosure will be described in detail with reference to the annexed drawings. In the drawings, the same elements are denoted by the same reference numerals throughout the drawings. In the following description, detailed descriptions of known functions and configurations incorporated herein have been omitted for conciseness and clarity.

Figure 2:
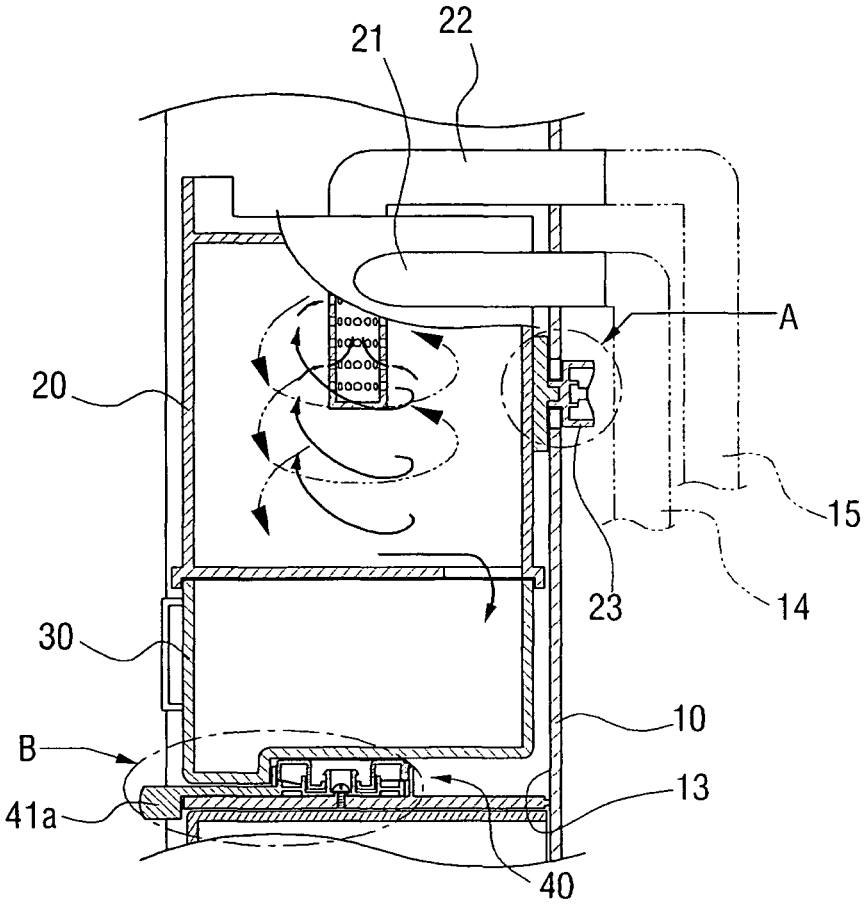
FIG. 2 is a cross-section view showing the main parts of the upright type vacuum cleaner when a cyclone unit and a dust collection bin are mounted in a cleaner body according to the first embodiment of the present disclosure.

FIGS. 1 and 2 show an example of an upright type vacuum cleaner according to a first embodiment of the present disclosure. Referring to FIGS. 1 and 2, the upright type vacuum cleaner according to the first embodiment of the present disclosure comprises a cleaner body 10, a cyclone cylinder 20, and a dust collection bin 30.

A vacuum generation device (not shown) is mounted in the cleaner body 10. Also, a brush assembly 12 is disposed at the lower side of the cleaner body 10. A mounting space 13 in which the cyclone cylinder 20 and the dust collection bin 30 are mounted is formed in the central portion of the front surface of the cleaner body 10.

An inflow passage 21 that communicates with the brush assembly 12 is formed in the upper side of the cyclone cylinder 20. Dirt flowing from a cleaning surface via the brush assembly 12 flows into the cyclone cylinder 20 via the inflow passage 21.

The inflow passage 21 is formed in such a manner as to be capable of guiding the air drawn in therethrough in a tangential direction of the cyclone cylinder 20. Therefore, the air flowing via the inflow passage 21 forms whirling air current along an inner wall of the cyclone cylinder 20.

A discharge passage 22 that communicates with the vacuum generation device (not shown) is formed in the central portion of the upper surface of the cyclone cylinder 20. The air separated from dirt in the cyclone cylinder 20 is discharged to the outside of the cleaner body 10 via the discharge passage 22 and the vacuum generation device.

One ends of a pair of tubes 14, 15 are disposed at an inner wall of the mounting space 13 and the other ends thereof are connected to the vacuum generation device and the brush assembly 12 respectively. The pair of tubes 14, 15 is arranged so as to let their respective end portions face the front side.

Correspondingly, the inflow passage 21 and the discharge passage 22 of the cyclone cylinder 20 are arranged in parallel, facing the rear side. Accordingly, simply by moving the cyclone cylinder 20 in a horizontal direction, the inflow passage 21 and the discharge passage 22 can be easily connected to the pair of tubes 14, 15.

Figure 3:
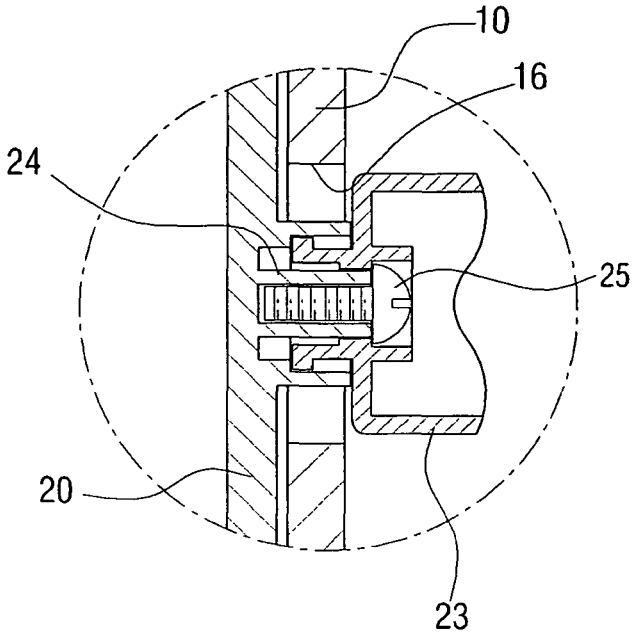
FIG. 3 is an enlarged view of the part "A" of FIG. 2.

A locking handle 23 is formed at the outer side of the rear portion of the cyclone cylinder 20. As shown in FIG. 3, a first hinge shaft 24 projects from the outer surface of the cyclone cylinder 20 and the locking handle 23 is rotatably connected to the first hinge shaft 24 by a first screw 25.

Figure 4:
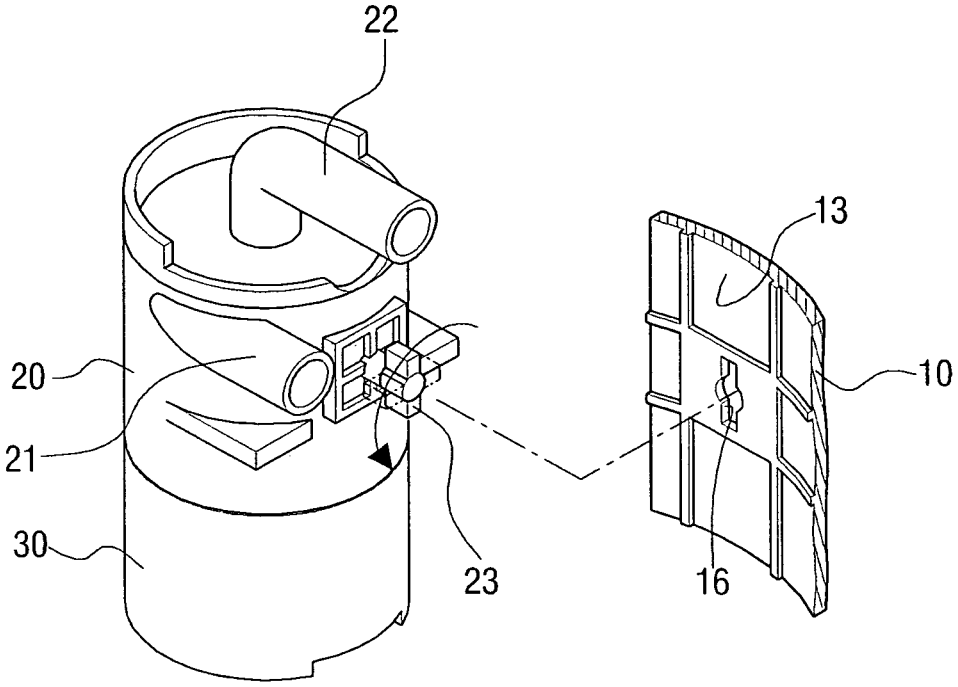
FIG. 4 is an exploded perspective view to explain a connection state between a locking handle and a handle connection part of the upright type vacuum cleaner according to the first embodiment of the present disclosure.

As shown in FIG. 4, a handle connection part 16 is formed on a corresponding part of the cleaner body 10. If the locking handle 23 passes through the handle connection part 16 and then is rotated by 90°, the cyclone cylinder 20 is fixedly mounted in the cleaner body 10.

Figure 5:
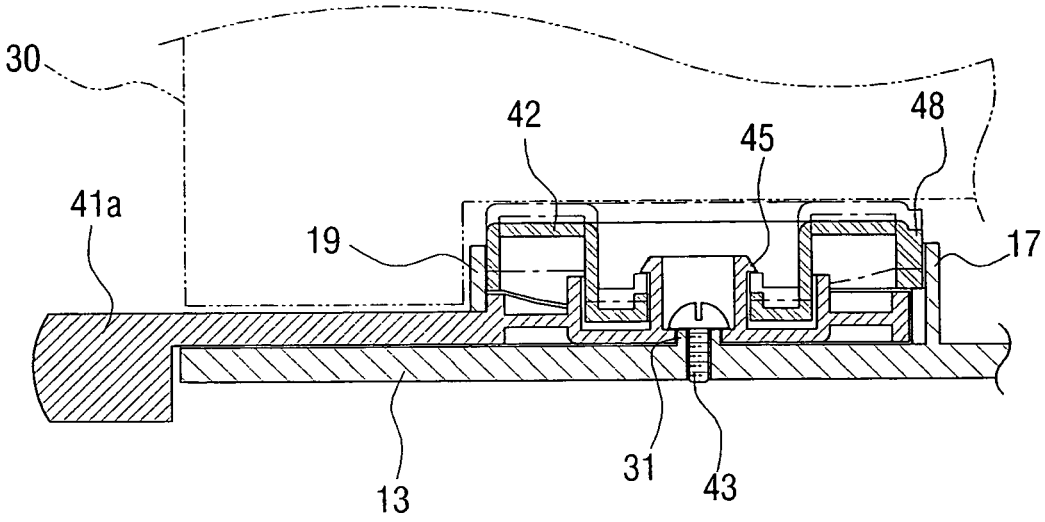
FIG. 5 is an enlarged view of the part "B" of FIG. 2.
Figure 6:
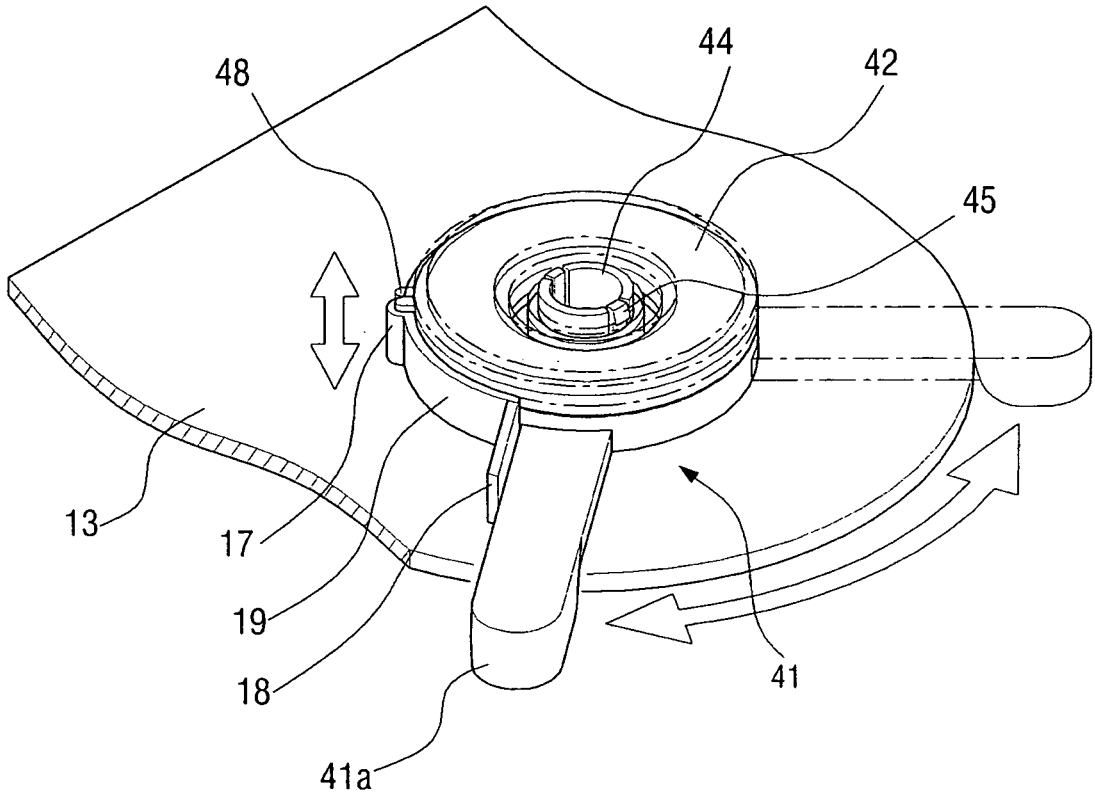
FIG. 6 is a perspective view showing a locking unit of the upright type vacuum cleaner according to the first embodiment of the present disclosure.

As shown in FIGS. 5 and 6, a lifting/lowering unit 40 is disposed on the bottom surface of the mounting space 13, and, as shown in FIG. 2, the dust collection bin 30 is removably anchored to the lower side of the cyclone cylinder 20 by the lifting/lowering unit 40.

Figure 7:
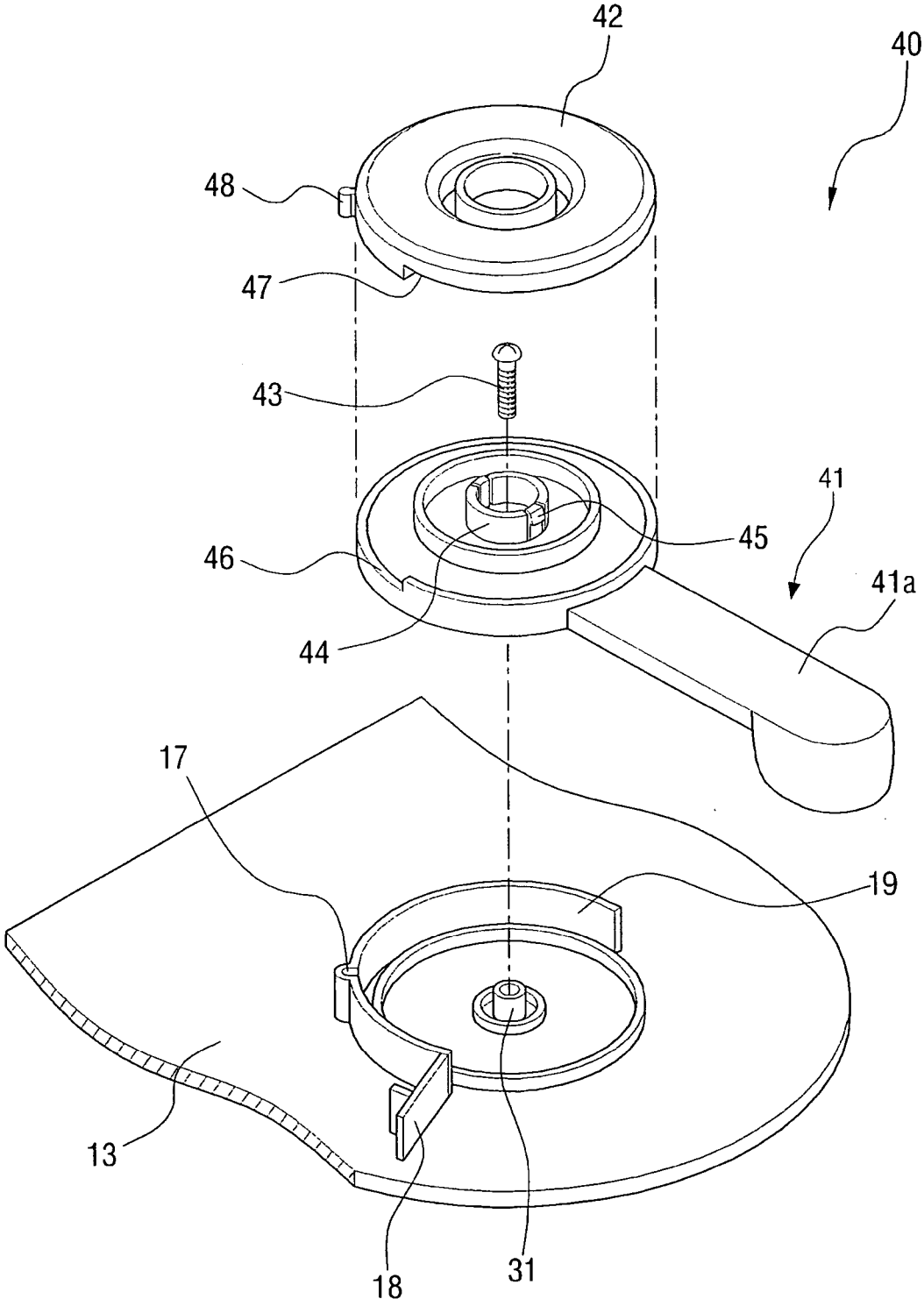
FIG. 7 is an exploded perspective view showing the locking unit of the upright type vacuum cleaner according to the first embodiment of the present disclosure.

The lifting/lowering unit 40 comprises a lifting/lowering control part 41 having a lever part 41*a* and a locking disk 42. As shown in FIGS. 6 and 7, a second hinge shaft 31 projects from the bottom surface of the mounting space 13 and the lifting/lowering control part 41 is rotatably connected to the second hinge shaft 31 by a second screw 43.

A third hinge shaft 44 of a hollow projects upwardly from the center of the lifting/lowering control part 41. The locking disk 42 is connected to the third hinge shaft 44 in such a manner as to be capable of being vertically moved. A hook 45, as shown in FIG. 7, prevents separation of the locking disk 42.

A first cam part 46 is formed on the top surface of the lifting/lowering control part 41 and a second cam part 47 is formed on the bottom surface of the locking disk 42 to correspond to the first cam part 46. The locking disk 42 vertically moves along the third hinge shaft 44 by the interaction between the pair of cam parts 46, 47.

A protrusion 48 is formed at a side of the outer circumference of the locking disk 42, and a guide part 17 is formed on the bottom surface of the mounting space 13 to prevent the rotation of the locking disk 42 in association with the protrusion 48. Reference numeral 18 of FIG. 7 indicates a stopper.

Accordingly, as shown in FIG. 6, if the lever part 41*a* of the lifting/lowering control part 41 is rotated to the left, the locking disk 42 is lowered to be in an unlocked state, and, if the lever part 41 is rotated to the right, the locking disk 42 is lifted to be in a locking state.

In FIG. 7, a supporter 19 is shown, which supports the bottom surface of the dust collection bin 30 to prevent the bottom surface of the dust collection bin 30 from being in contact with the lifting/lowering unit 40 when the lifting/lowering unit 40 is in the unlocked state.

In order to mount the cyclone cylinder 20 and the dust collection bin 30 in the cleaner body 10, a user positions the locking handle 23 first as shown in FIG. 4.

The inflow passage 21, the discharge passage 22 and the locking handle 23 of the cyclone cylinder 20 are inserted into the pair of tubes 14, 15 and the handle connection part 16 of the cleaner body 10, and then the locking handle 23 is rotated by 90° in the arrow direction shown in FIG. 4.

Simply by performing the operation described above, the cyclone cylinder 20 is fixedly mounted in the mounting space 13 of the cleaner body 10 and accordingly an extra part or tool for mounting the cyclone cylinder 20 is not required.

Then, as shown in FIG. 6, the user rotates the lever part 41*a* of the lifting/lowering control part 41 in the left direction, pushes the dust collection bin 30 inside the mounting space 13 of the cleaner body 10, and then rotates the lever part 41*a* in the right direction.

Consequently, the locking disk 42 moves upwardly along the third hinge shaft 44 by the interaction between the pair of cam parts 46, 47 and accordingly the dust collection bin 30 is fixedly mounted to the bottom surface of the cyclone cylinder 20.

In order to empty the dust collection bin 30, the user simply rotates the lever part 41*a* to the left as shown in FIG. 6. Then, the locking disk 42 is lowered to be in the unlocked state.

That is, due to the interaction between the cam part 46 of the lifting/lowering control part 41 and the cam part 47 of the locking disk 42 and the self weight of the dust collection bin 30, the locking disk 42 moves downwardly along the third hinge shaft 44 of the lifting/lowering control part 41.

Therefore, the user can pull out the dust collection bin 30 to empty it and thus can mount or dismount the dust collection bin 30 in or from the cleaner body 10 without causing friction, thereby preventing the bottom of the dust collection bin 30 from being damaged.

Also, when it is necessary to space the cyclone cylinder 20 from the cleaner body 10 to clean or repair it, the user dismounts the dust collection bin 30 from the cleaner body first and positions the locking handle 23 as shown in FIG. 4.

In this state, the cyclone cylinder 20 can be spaced from the cleaner body 10 simply by pulling out the cyclone cylinder 20. Therefore, no extra part or tool for spacing the cyclone cylinder 20 is required.

Figure 8:
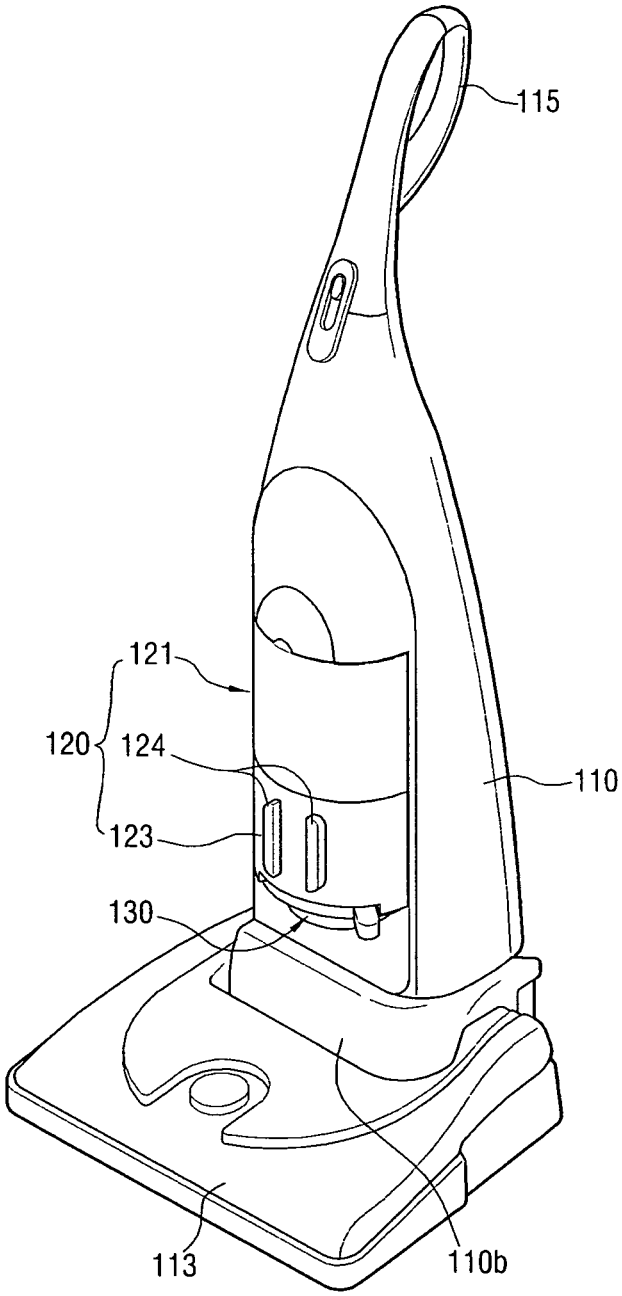
FIG. 8 is a perspective view showing a vacuum cleaner according to a second embodiment of the present disclosure.
Figure 9:
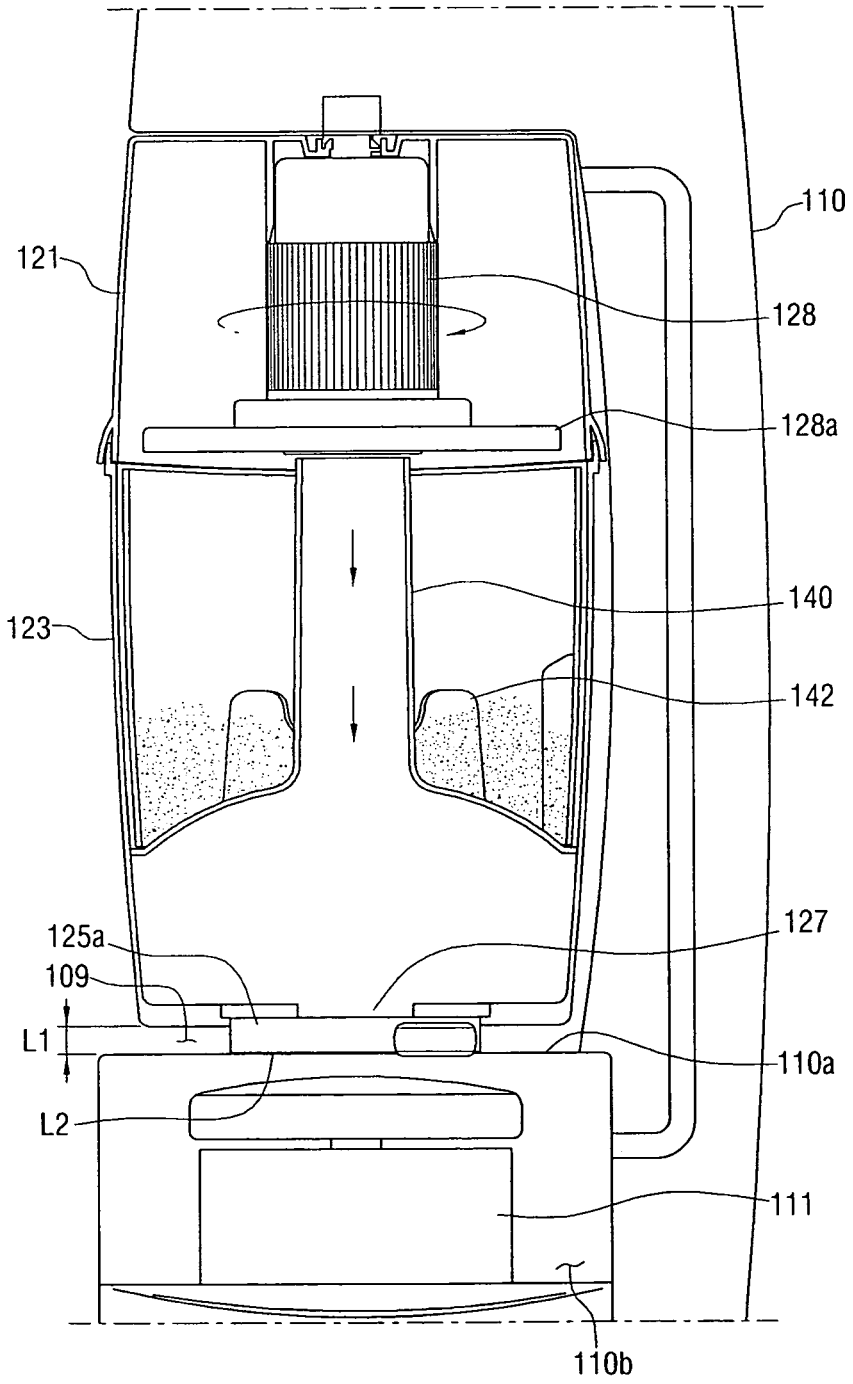
FIG. 9 is a schematic view showing a body part of FIG. 8.

Referring to FIGS. 8 and 9, a vacuum cleaner according to a second embodiment of the present disclosure comprises a cleaner body 110, a dust collection device 120, and a lifting/lowering unit 130.

The cleaner body 10 has a handle 115 formed at the top end of the cleaner body 10 to be capable of being gripped by a user, and a brush assembly 113 for drawing-in dust from the outside of the cleaner body 110 is connected to the bottom end of the cleaner body 110.

The dust collection device 120 includes a cyclone cylinder 121 fixedly installed in a mounting space formed on the cleaner body 110, the cyclone cylinder 121 drawing-in external air and separating dust from the suctioned air, and a dust collection bin 123 mounted to be in close contact with the bottom end of the cyclone cylinder 121 so as to collect dust separated in the cyclone cylinder 121. The dust collection bin 123 can be spaced from the cyclone cylinder 121, which is fixedly installed on the cleaner body 110. From the front face of the dust collection bin 123, gripping knobs 124 are projected so that the duct collection bin can be gripped by the user. At the center of the dust collection bin 123, there is provided an outlet tube 140, through which air is discharged from the cyclone cylinder 121, and at the central area of the bottom wall of the dust collection bin 123, there is provided an outlet port 127, through which the air passing the outlet tube 140 is discharged to the outside.

Figure 10:
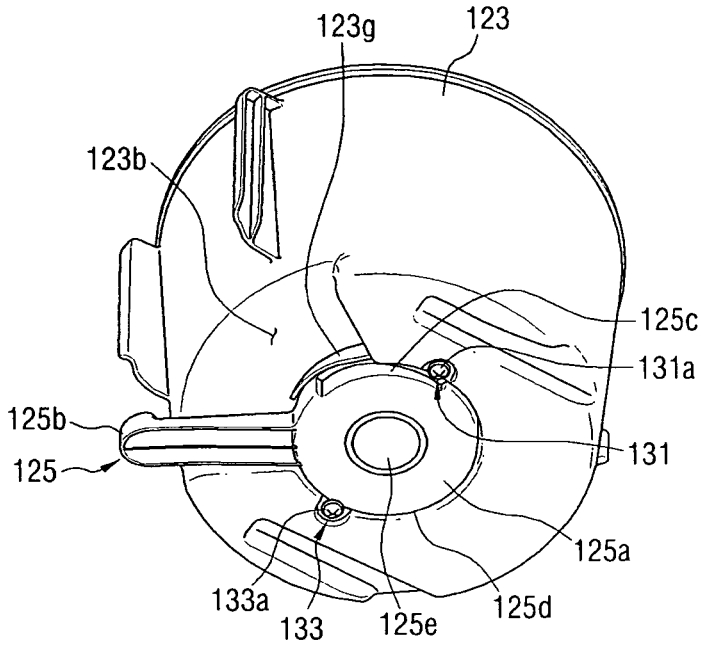
FIG. 10 shows the dust collection bin and the lifting/lowering unit of FIG. 8 in an assembled state.
Figure 11:
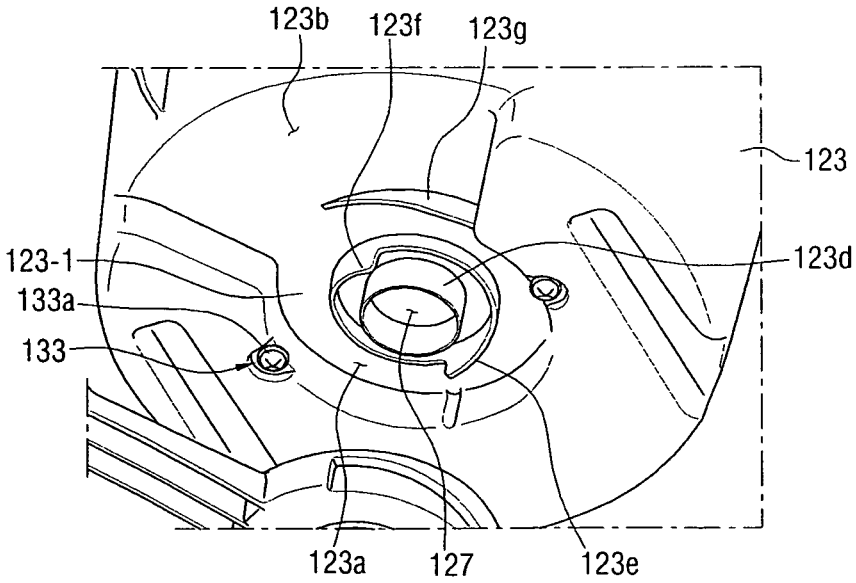
FIG. 11 shows the dust collection bin and the lifting/lowering unit of FIG. 8 in a disassembled state.

Referring to FIGS. 10 and 11, on the outer bottom surface of the dust collection bin 123, there are provided a first recess 123*a* formed at the central area of the outer bottom surface in such a manner as to be capable of receiving a body part 125*a* of a lifting/lowering control member 125, and a second recess 123*b* formed in a fan shape on the outer bottom surface and connected to the first recess 123*a*, the second recess 123*b* cooperating with a lever part 125*b*, which is formed on the lifting/lowering member 125, in such a manner as to limit the rotating angle of the body part 125*a*. In FIG. 9, the vacuum cleaner also includes a filter unit 128, a skirt 128*a* for interrupting the backflow of dust or dirt, and an anti-rotation member 142 for preventing the dust stored in the dust collection bin 123 from being rotated by swirling airflow.

Referring to FIGS. 9 to 13, the lifting/lowering unit 130 comprises a plurality of cam guides 123*e*, 123*f*, 123*g*, 125*g* and 125*h*, a lifting/lowering control member 125, and first and second central pipes 123*d* and 125*f*, wherein the lifting/lowering unit 130 is mounted on the outer bottom surface of the dust collection bin 123, and when the dust collection bin 123 is positioned in the mounting space 109, the lifting/lowering unit 130 comes into close contact with the bottom wall 110*a* of the mounting space 109. By increasing or decreasing the gap L1 between the bottom wall 110*a* and the bottom surface of the lifting/lowering unit 130, the lifting/lowering unit 130 lifts or lowers the dust collection bin 123 in relation to the bottom wall 110*a* of the mounting space 109. When the lifting/lowering unit 130 presses on the bottom wall 110*a*, thereby lifting the dust collection bin 123 to increase the gap L1 between the bottom surface of the collection bin 123 and the bottom wall 110*a*, the dust collection bin 123 comes into close contact with the outer bottom surface of the cyclone cylinder 121. In contrast, when the lifting/lowering unit 130 decreases the gap L1 between the bottom surface of the dust collection bin 123 and the bottom wall 110*a*, thereby lowering the dust collection bin 123, the dust collection bin 123 can be spaced from the cyclone cylinder 121, so that the dust collection bin 123 can be pulled out from the mounting space 109.

The cam guides comprise first to fifth cam guides 123*e*, 123*f*, 125*g*, 125*h* and 123*g*, wherein the first cam guide 123*e* and the second cam guide 123*f* project from the outer bottom surface of the dust collection bin 123 along the circumference of the outlet port 127 in such a manner as to surround the first central pipe 123*d*. The fifth cam guide 123*g* has the same circular arc as the first recess 123*a* and is projectedly formed in the second recess 123*b*. Due to the fifth cam guide 123*g*, when the lifting/lowering control member 125 rotates, a part of the top surface of the lever part 125*b* comes into slidable contact with the fifth cam guide 123*g*, thereby maintaining the gap between the outer bottom surface 123-1 of the dust collection bin 123 and the top surface of the lever part 125*b*. As a result, when the body part 125*a* is spaced away from the outer bottom surface 123-1 by coming into contact with the first and second cam guides 123*e* and 123*f*, the lever part 125*b* is likewise spaced from the outer bottom surface 123-1 by coming into contact with the fifth cam guide 123*g*, whereby the lifting/lowering control member 125 can be stably rotated. The third and fourth cam guides 125*g* and 125*h* are formed on the lifting/lowering control member 125, wherein the third and fourth cam guides 125*g* and 125*h* are engaged and rotated with the first and second cam guides 123*e* and 123*f*, respectively.

Figure 12:
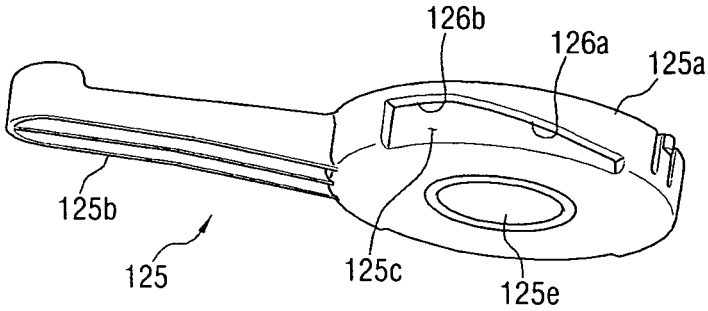
FIG. 12 is a perspective view showing a lifting/lowering control member of the lifting/lowering unit in FIG. 8, which is viewed from the lower side thereof.
Figure 13:
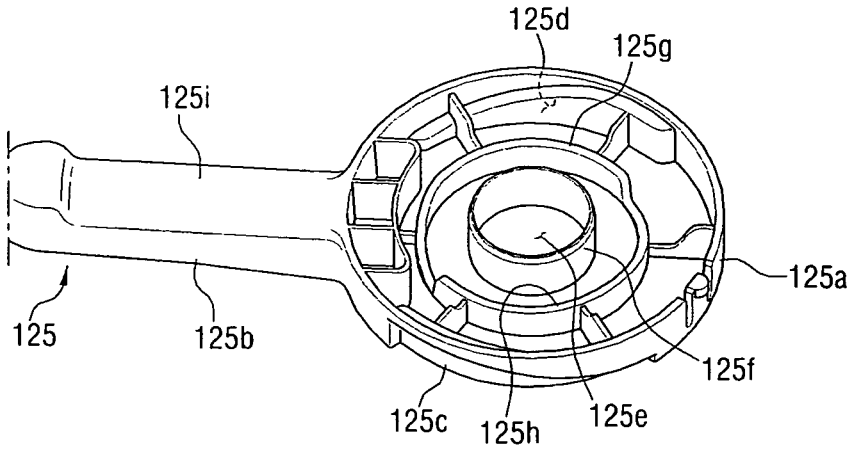
FIG. 13 is a perspective view showing the lifting/lowering control member of the lifting/lowering unit in FIG. 8, which is viewed from the upper side thereof.

The lifting/lowering control member 125 consists of a body part 125*a* and a lever part 125*b*. The body part 125*a* is formed in a circular shape and the lever part 125*b* extends from the circumference of the body part 125*a* to a side of the body part 125*a*. The body part 125*a* has a second central pipe 125*f*, which is formed on one of the bottom and top surfaces of the body part 125*a* in such a manner as to be capable of being inserted into the first central pipe 123*d*, wherein the second central pipe 125*f* has a bore 125*e* formed through the second central pipe 125*f*. The bore 125*e* formed through the body part 125*a* is communicated with the outlet port 127 formed in the dust collection bin 123, so that air can be discharged to the motor chamber 110*b*. If the body part 125*a* is rotated in one direction or the other direction, the first cam guide 123*e* and the second cam guide 123*f* are engaged and rotated with the third cam guide 125*g* and the fourth cam guide 125*h*, respectively, thereby lifting or lowering the dust collection bin 123. Referring to FIGS. 12 and 13, on the circumference of the body part 125*a*, there are formed third and fourth recesses 125*c* and 125*d*, which are equi-spaced from the lever part 125*b*, wherein the top wall of each of the recesses 125*c* and 125*d* is divided into an inclined guide wall 126*a* and a horizontal guide wall 126*b*, which extends horizontally from the upper end of the inclined guide wall. FIG. 12 shows only the third recess 125*c* and the guide walls 126*a*, 126*b* thereof. The fourth recess 125*d* and the guide walls thereof, which are not shown in FIG. 12, are formed in the same construction as the third recess 125*c* and the guide walls thereof opposite to the third recess 125*c* and the guide walls thereof.

Referring to FIGS. 10, 11, and 14 to 16, the dust collection bin 123 is provided with at least two anchoring members so as to allow the lifting/lowering control member 125 to be engaged with the dust collection bin 123, wherein the anchoring members include first and second anchoring screws 131 and 133, which have heads 131*a* and 133*a*, respectively. When the first and second anchoring screws 131 and 133 are provided on the dust collection bin 123, the heads 131*a* and 133*b* are partially inserted into the third and fourth recesses 125*c* and 125*d*, respectively. That is, if the lifting/lowering control member 125 is inserted into the first and second recesses 123*a* and 123*b* and then the anchoring screws 131 and 133 are fitted on the outer bottom surface of the dust collection bin 123, the heads 131*a* and 133*a* of the first and second anchoring screws 131 and 133 are partially inserted into the third and fourth recesses 125*c* and 125*d*, as a result of which the lifting/lowering control member 125 is in a semi-restrained condition, thereby being prevented from being released downward away from the dust collection bin 123.

Now, the movement of the dust collection bin 123, which is caused by the lifting/lowering unit 130 according to the second embodiment of the present disclosure, is described with reference to FIGS. 8 to 16.

Figure 14:
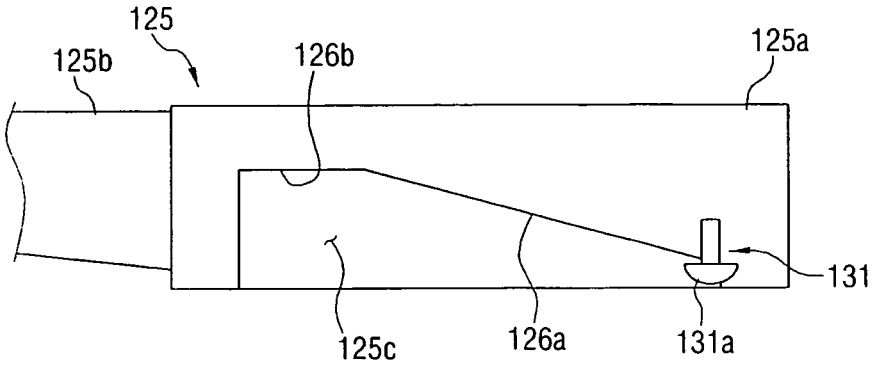
FIGS. 14 to 16 show the operation of a screw member inserted into a recess in a state in which the lever part of the lifting/lowering control member is not rotated.
Figure 15:
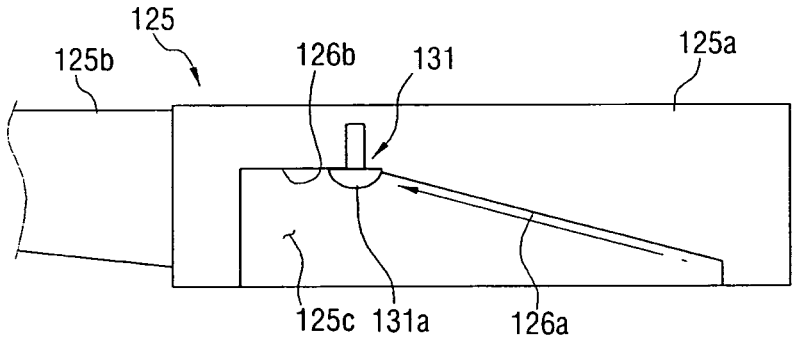
Figure 16:
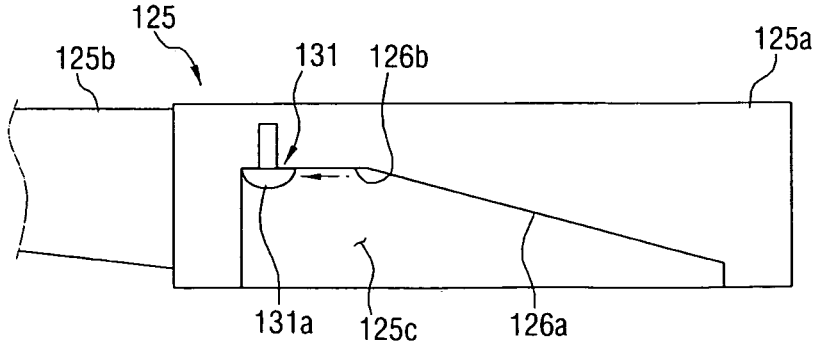

In a state in which the lever part 125*b* is not rotated as shown in FIG. 14, the heads 131*a* and 133*a* of the first and second anchoring screws 131 and 133 are positioned at the lower most ends of the inclined guide walls 126*a*. If the lever part 125*b* is rotated in a direction for lifting the dust collection bin 123, the first and second cam guides 123*e* and 123*f* and the third and fourth cam guides 125*g* and 125*h* cooperatively slide in relation to each other, thereby lifting the dust collection bin 123, as a result of which the lifting/lowering collection member 125 is relatively lowered in relation to the dust collection bin 123. At this time, the heads 131*a* and 133*a* of the first and second anchoring screws 131 and 133 are slid along the inclined guide walls 126*a*. Thereafter, if the lever part 125*b* is further rotated forward so as to maintain the lifted condition of the dust collection bin 123 after the lifting of the dust collection bin 123 is terminated, the heads 131*a* and 133*a* are moved along the horizontal guide walls 126*b* and positioned as shown in FIG. 16.

In this manner, because the lifting/lowering control member 125 for rendering the dust collection bin 123 to be engaged with the outer bottom surface of the cyclone cylinder 121 is provided on the outer bottom surface 123-1 of the dust collection bin 123 rather than on the cleaner body 110, if the lever part 125*b* is rotated in the direction for lifting the lifting/lowering control member 125, the dust collection bin 123 is lifted and the lifting/lowering control member 125 is lowered in relation to the dust collection bin 123. Consequently, the dust collection bin 123 is lifted and comes into close contact with the lower end of the cyclone bin 121, and the lifting/lowering control member 125 is lowered so as to compresses the bottom wall 110*a* of the mounting space 109 (see FIG. 9), whereby no gap is produced between the lifting/lowering unit 130 and the bottom wall 110*a* of the mounting space 109. According to the second embodiment of the present disclosure, the lifting/lowering unit 130 is provided on the bottom side of the dust collection bin 123, so that the lifting/lowering control member 125 is moved and presses against the bottom wall 110*a* of the mounting space 109. Therefore, no gap is produced between the bottom wall 110*a* of the mounting space 109 and the lifting/lowering unit 130, thereby preventing the leakage of discharge air. Referring to FIG. 9, the motor chamber 110*b* formed on the cleaner body 110 with a vacuum motor 111 disposed therein and the lifting/lowering unit 130 are sealed substantially without a gap L2 between them, so that clean air, from which dust has been removed in the cyclone cylinder 121, is all directed toward the motor chamber 110*b* via the outlet port 127 without leaking out through the gap L2, whereby a pressure loss caused by the leakage of air can be reduced. In addition, because the first and second central pipes 123*d* and 125*f* are positioned in such a manner that one is put upon another, no discharge air leaks out. Furthermore, because the lifting/lowering unit 130 is mounted on the bottom side of the dust collection bin 123, even if dirt drops from the cyclone cylinder 121 after the dust collection bin 123 has been removed from the mounting space 109, the dirt drops on the bottom wall 110*a* of the mounting space 109, thereby preventing the pollution and malfunction of the lifting/lowering unit 130 and increasing an ease of cleaning of the cleaner body 110.

Figure 17:
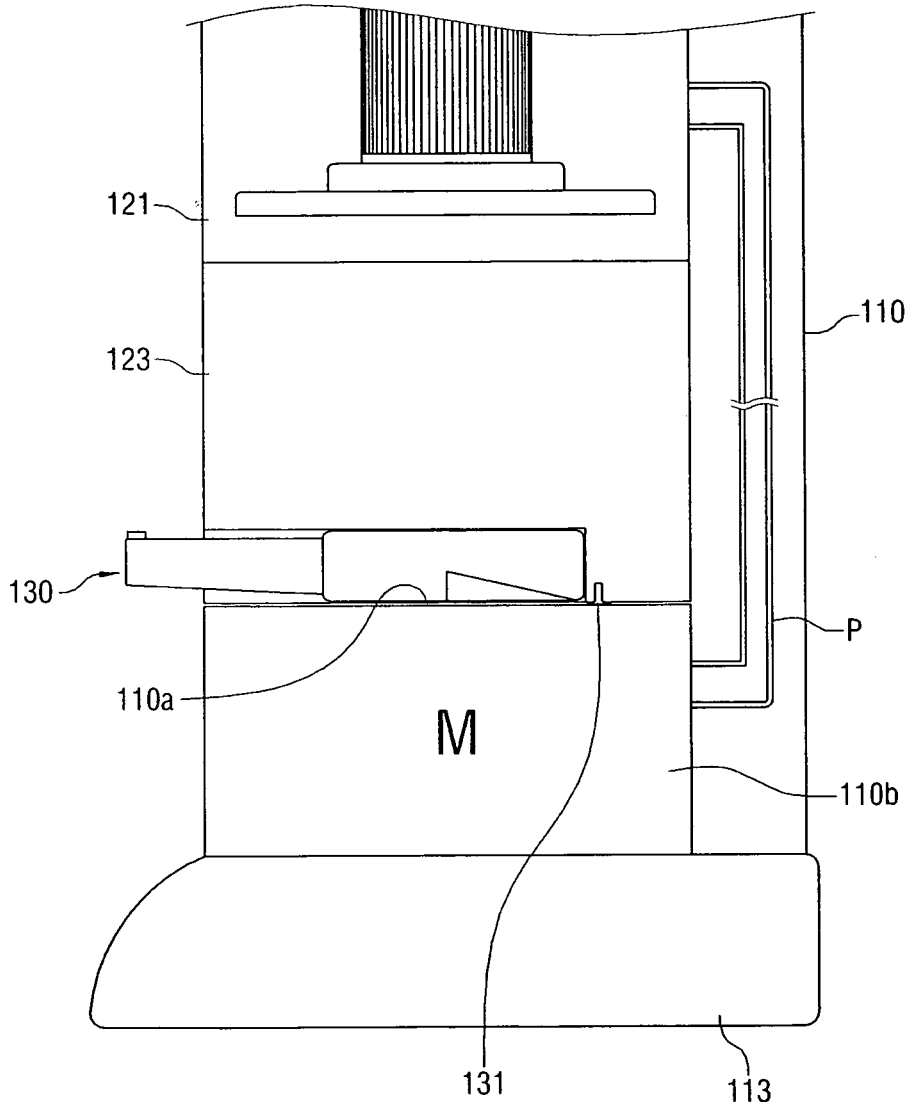
FIG. 17 shows a vacuum cleaner according to a third embodiment of the present disclosure.
Figure 18:
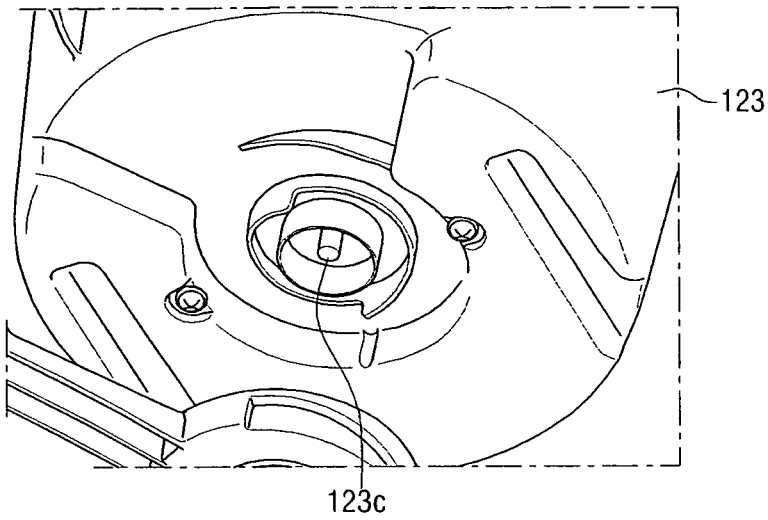
FIG. 18 is a perspective view showing the bottom side of the dust collection bin of FIG. 17.
Figure 19:
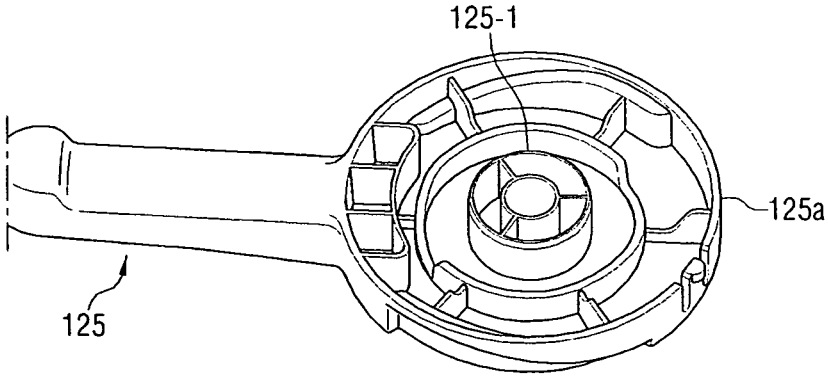
FIG. 19 is a perspective view of the lifting/lowering control member of FIG. 17, which is viewed from the upper side thereof.

Now, a vacuum cleaner according to a third embodiment of the present disclosure is described with reference to FIGS. 17 to 19. Here, component parts performing similar or analogous functions as the second embodiment are labeled in multiples of one hundred.

The third embodiment is different from the second embodiment in that a discharge flow passage P is provided within the cleaner body 110 for communicating the motor chamber 110*b* and the cyclone cylinder 121 in order to discharge air, from which dust has been removed in the cyclone cylinder 121, to the motor chamber 110*b*. That is, the third embodiment is constructed in such a manner that the air of the cyclone cylinder 121 is adapted to be introduced into the motor chamber 110*b* through the discharge flow passage P, unlike the second embodiment that is provided with an outlet tube and an outlet port 127, which are formed in the dust collection bin 123, and a bore 125*e*, which is formed in the lifting/lowering unit 130. Referring to FIG. 18, no outlet port is formed through the bottom wall of the dust collection bin 123 and a cylindrical rotary shaft 123*c* extends from the bottom part of the dust collection bin 123. Referring to FIG. 19, the central area of the body part 125*a* of the lifting/lowering control member 125 is provided with a small cylinder 125-1, into which the rotary shaft 123*c* can be inserted, without being formed with an opening. The rotary shaft 123*c* is inserted into the cylinder 125-1 so as to center the lifting/lowering control member 125, when the control member 125 is rotated. The other components of the second embodiment are equal to those of the second embodiment. Therefore, reference numerals and description thereof are omitted.

According to the second and the third embodiments described above, the dust collection device for a vacuum cleaner is configured in such a manner that lifting/lowering control member 125 is mounted on the bottom side of a dust collection bin 123 so that the dust collection bin and the lifting/lowering control member are movable to push away one another. As a result, no gap is produced between the lifting/lowering control member 125 and a motor chamber 110*b*, whereby discharge air is completely blocked not to leak out. Furthermore, because the air is discharged through the bottom end of the cyclone cylinder 121 without leaking out, it is possible to reduce the length of the discharge flow passage P can be shortened as well as to reduce a pressure loss caused by the leakage of air from the vacuum cleaner.

In addition, because the lifting/lowering control member 125 is mounted on the outer bottom surface of the dust collection bin 123, dust dropping from the cyclone cylinder 121 is not introduced into the lifting/lowering unit 130 even if the dust collection bin 123 is removed from the cyclone cylinder 121. As a result, it is possible to maintain the performance of the lifting/lowering unit 130, to prevent the malfunction of the lifting/lowering unit and to increasing the lifetime of the lifting/lowering unit.

In the second and the third embodiments, it is possible to provide the locking handle 23 at the outer side of the rear portion of the cyclone cylinder 121 and the handle connection part 16 at the corresponding part of the cleaner body 110 as in the first embodiment. In this case, by passing the locking handle 23 through the handle connection part 16 and then rotating the locking handle 23 by ninety degrees (90°), the cyclone cylinder 121 is fixedly mounted in the cleaner body 110.

While the disclosure has been shown and described with reference to certain embodiments thereof, it will be understood by those skilled in the art that various changes in form and details may be made therein without departing from the spirit and scope of the disclosure as defined by the appended claims.

What is claimed is:

1. An upright type vacuum cleaner, comprising:

a cleaner body formed with a mounting space;

a vacuum motor mounted in the cleaner body to produce suction force;

a brush assembly connected to the cleaner body;

a dust collection device mounted in the mounting space and having a dust collection bin and a cyclone cylinder; and a lifting/lowering unit for lifting or lowering the dust collection bin in relation to the cleaner body so that the dust collection bin is anchored in the mounting space or removed from the mounting space, respectively, wherein the cyclone cylinder has a locking handle and the cleaner body has a handle connection part formed on a corresponding part of the cleaner body so that the locking handle can be removably connected to the handle connection part, wherein the lifting/lowering unit is installed at a lower end of the dust collection bin and is mounted in or dismounted from the mounting space along with the dust collecting bin.

2. The upright type vacuum cleaner as claimed in claim 1, wherein the locking handle is a rotary knob.

3. The upright type vacuum cleaner as claimed in claim 1, wherein the dust collection bin is anchored by the lifting/lowering unit that is vertically movable.

4. The upright type vacuum cleaner as claimed in claim 3, wherein the lifting/lowering unit comprises a lever part and a locking disk that vertically moves in association with the rotation of the lever part.

5. The upright type vacuum cleaner as claimed in claim 4, wherein the lever part and the locking disk are operated in a cam manner.

6. An upright type vacuum cleaner, comprising:

a cleaner body that has a vacuum generation device mounted therein and a brush assembly formed at the lower side thereof;

a cyclone cylinder that separates dirt from air drawn in through an inflow passage communicating with the brush assembly, and discharges cleaned air through a discharge passage communicating with the vacuum generation device; and a dust collection bin that is removably connected to the lower side of the cyclone cylinder and collects dirt separated from the air in the cyclone cylinder, wherein the dust collection bin is anchored by a lifting/lowering unit, wherein the lifting/lowering unit is installed at a lower end of the dust collection bin and is mounted in or dismounted from the cleaner body along with the dust collecting bin.

7. The upright type vacuum cleaner as claimed in claim 6, wherein the lifting/lowering unit comprises a lever part and a locking disk that vertically moves in association with the rotation of the lever part.

8. The upright type vacuum cleaner as claimed in claim 7, wherein the locking disk is operated in a cam manner.

9. The upright type vacuum cleaner as claimed in claim 1, wherein the dust collection bin has an outer surface formed with a recess, and the lifting/lowering unit is fitted in the recess.

10. The upright type vacuum cleaner as claimed in claim 9, wherein the lifting/lowering unit comprises:

a lifting/lowering control member fitted in the recess; and a plurality of cam guides that are provided on the lifting/lowering control member and the outer bottom surface of the dust collection bin, respectively, for lifting and lowering the dust collection bin upon rotation of the lifting/lowering control member.

11. The upright type vacuum cleaner as claimed in claim 10, wherein the lifting/lowering control member comprises a lever part capable of being gripped by a hand and a body part integrally formed with the lever part.

12. The upright type vacuum cleaner as claimed in claim 11, wherein the plurality of cam guides comprises first and second cam guides projecting from the outer bottom surface of the dust collection bin, and third and fourth cam guides projecting from the body part in such a manner as to be engaged with the first and second cam guides.

13. The upright type vacuum cleaner as claimed in claim 12, wherein the plurality of cam guides further comprises a fifth cam guide projecting from the outer bottom surface of the dust collection bin in such a manner as to come into contact with the lever part, thereby separating the lever part from the outer bottom surface of the dust collection bin.

14. The upright type vacuum cleaner as claimed in claim 1, wherein the dust collection bin has an outer bottom surface including an air outlet port formed therethrough and the lifting/lowering unit includes a bore formed therein, so that air purified in the cyclone cylinder is introduced into a motor chamber, within which the vacuum generation device is installed, via the air outlet port and the bore.

15. The upright type vacuum cleaner as claimed in claim 11, further comprising a discharge flow passage within the cleaner body for communicating between a motor chamber, within which the vacuum generation device is installed, and the cyclone cylinder in order to discharge air to the motor chamber.

16. The upright type vacuum cleaner as claimed in claim 15, wherein the dust collection bin comprises a cylindrical rotary shaft extending from the outer bottom surface of the dust collection bin.

17. The upright type vacuum cleaner as claimed in claim 16, wherein the body part of the lifting/lowering control member comprises a cylinder into which the cylindrical rotary shaft can be inserted so as to center the lifting/lowering control member when the lifting/lowering control member is rotated.

* * * * *